United States Patent [19]

Hanson et al.

[11] Patent Number: 5,066,517

[45] Date of Patent: Nov. 19, 1991

[54] METHOD FOR ENHANCING THE PERMANENCE OF PRINTED IMAGES

[75] Inventors: William J. Hanson, Carlsbad; J. Randolph Sanders, San Diego, both of Calif.

[73] Assignee: AcuPrint, Inc., Carlsbad, Calif.

[21] Appl. No.: 449,780

[22] Filed: Dec. 12, 1989

[51] Int. Cl.[5] ..... B05D 5/00

[52] U.S. Cl. ..... 427/197; 427/202; 427/314; 427/359

[58] Field of Search ..... 427/197, 202, 359, 314

[56] References Cited

U.S. PATENT DOCUMENTS

| | | | |
|---|---|---|---|
| 4,100,309 | 7/1978 | Micklus | 427/2 |
| 4,119,094 | 10/1978 | Micklus et al. | 128/132 R |
| 4,373,009 | 2/1983 | Winn | 428/424.2 |
| 4,589,873 | 5/1986 | Schwartz et al. | 427/2 |
| 4,642,267 | 2/1987 | Creasy et al. | 428/413 |
| 4,666,437 | 5/1987 | Lambert | 604/265 |
| 4,729,914 | 3/1988 | Kliment et al. | 428/36 |

*Primary Examiner*—Bernard Pianalto

*Attorney, Agent, or Firm*—Baker, Maxham, Jester & Meador

[57] ABSTRACT

Apparatus for enhancing the permanence of printed images. A substrate with a heated, fused toner image is passed by a PTFE powder coated roller for selective contact therewith by a pivotable engagement bar. The PTFE particles are adhered only to the desired imprinted areas and not to the non-printed and non-selected areas of the substrate. The powder is dispensed on a selective basis to the surface of the substrate. The invention also includes the method for enhancing the permanence of a printed image on the substrate.

11 Claims, 2 Drawing Sheets

METHOD FOR ENHANCING THE PERMANENCE OF PRINTED IMAGES

FIELD OF THE INVENTION

This invention relates generally to a method and apparatus to prevent printed images from smearing or being subject to chemical attack, and more particularly provides a lubricating micropowder coating selectively applied to the printed images, at elevated temperatures, to enhance image permanence.

BACKGROUND OF THE INVENTION

The concept of applying a lubricating micropowder to printed images to enhance image permanence has been tried, with some measure of success. One such apparatus is described in U.S. Pat. No. 4,779,558. This patent shows a device for coating sheets of paper on which printed images have been applied, with one important aspect being to not apply so much powder as to prevent writing with a ball point pen while at the same time applying sufficient powder to reduce smearing of the printed images.

Some of the disadvantages of prior art micropowder application devices are that the micropowder is applied to the entire surface of the printed substrate, not just to the image areas. This results in a waste of the micropowder and thereby more rapid use of the supply and could interfere with writing on the non-printed areas of the substrate. Another disadvantage of the prior art is that the overcoating powder applied to the substrate and the images merely rest thereon as opposed to being adhered to the images and can thereby be dislodged during handling of the printed document, thereby reducing the effectiveness of the powder coating. On many documents only a certain portion of the printed areas are needed to have the image permanence enhanced but the prior art devices applies the same amount of powder to all of the printed areas, thereby needlessly consuming additional micropowder material and at the same time reducing the coefficient of friction on areas of documents which do not need image permanence protection, possibly interfering with their efficient handling, which normally requires that some element of friction be involved.

There are a number of application areas where enhanced image permanence can be beneficial. These include documents prepared for Magnetic Ink Character Recognition (MICR), machine readable bar codes and optical character recognition (OCR), photocopied and printed documents where it is desired to prevent chemical attack of toner images by, for example, the plasticizers contained in vinyl book covers, and other applications where it is useful to provide a protective barrier between printed indicia and sources of abrasion or chemical attack or both. A particular problem of non-impact printer produced documents are that they tend to transfer their image to vinyl material, such as notebook covers, especially when left exposed to a heat source, such as a car in the sunshine.

One of the more important areas where improvements are needed is where machine readable documents are automatically sorted. In a particular application where MICR readable toner is used to print financial documents such as checks, the smear problem can be significant. A serious limitation in utilizing non-impact printers to print MICR images has been the subsequent image smear as printed documents are processed through high-speed reader/sorters such as the IBM 3890. Documents having MICR images such as checks go through rapid automated clearing processes which often cause the image thereon to smear. The frictional forces involved in the handling of documents in reader/sorters, when opposed by the shear strength of the toner, results in some of the top portions of the toner actually tearing off. Some attempts in this area have been made to resolve the problem by developing a specialized MICR toner, more resistant to smearing. The problem with this solution is the tremendous development expense, coupled with the additional care that must be taken not to compromise base image quality, and the fact that the solution is machine specific. The costs for automatic sorting increases dramatically when character smear requires hand sorting. Just one or two percent unreadable documents can mean hundreds of millions of dollars in additional check sorting costs annually on a national basis.

SUMMARY OF THE INVENTION

This invention provides a protective overcoating to portions of printed areas by selective deposition of micropowder to printed image areas. It has been found that polytetrafluoroethylene (PTFE, often referred to under the DuPont trademark Teflon) powders with particle sizes of 5–40 microns perform particularly well with this invention. The basic concept is to apply the lubricating micropowder to a printed sheet at an elevated temperature and to apply pressure selectively at the printed areas of interest so that the powder is positively adhered to the image elements.

In one embodiment, the invention is a modification or accessory to a non-impact printer, such as a laser printer, which operates on the printed page after it passes through a roll fuser. The paper with the toner thereon is heated in the fuser and is further processed in the fuser by the application of pressure. Immediately after being fused the print passes through the image permanence device at an elevated temperature of approximately 190° F. The image permanence device includes a micropowder dispenser for applying the powder to an applicator roller which is selectively in contact with the area on the paper to be protected. An engagement bar selectively brings the print into contact with the applicator roller thereby selectively applying the micropowder to the area of the printed image of interest. The toner at this temperature is still somewhat conformable so that the combination of the conformable toner image, the micropowder coating on the applicator roller and the pressure in the applicator nip provided by the engagement bar causes the powder to be pressed into the image areas of the print. There are forces, which are more fully explained later, which cause the micropowder to be retained on the applicator roller until those forces are overcome. It has been found that the forces existing between the micropowder and the heated image are greater than those between the micropowder and the roller so that a physical transfer occurs and micropowder adheres to the heated image when contact between the image and the coated roller is made. Micropowder which is not in the area of particular interest, that is, the non-imprinted areas of the page and that portion of the printed image which is not pressed into the image by the engagement bar, remains free of the micropowder coating so that the coefficient of friction of the non-selected areas is not materially affected and there is no impediment to writing on the substrate surface with an instrument such a ball point pen.

The invention can either be an integral part of a laser printer or photocopier, for example, and incorporated therein before being first delivered to a customer, or it can be in the form of a an add-on accessory which is added to the printer or photocopier as desired.

BRIEF DESCRIPTION OF THE DRAWING

The objects, advantages and features of this invention will be more readily perceived from the following detailed description when read in conjunction with the accompanying drawing, in which.

DESCRIPTION OF THE PREFERRED EMBODIMENTS

Figure 1:
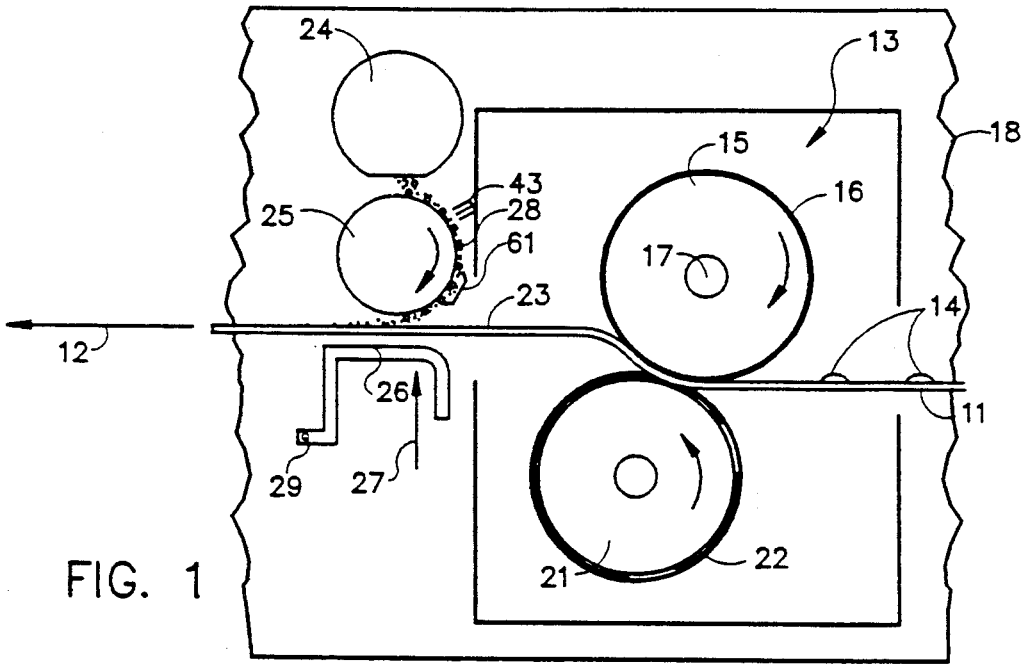
FIG. 1 is a schematic side view of the invention in conjunction with the fuser portion of a non-impact printer.

With reference now to the drawing, and more particularly to FIG. 1 thereof, there is shown the fuser portion of a non-impact printer with the invention incorporated therewith. A substrate such as paper 11 is fed in the direction of arrow 12 into fuser 13 of a typical laser electrophotographic printer. Unfused image elements 14 reside on top of the paper before it passes between the operative elements of the fuser. The fuser primarily consists of heated roller 15 which is typically a metal roll which may have a PTFE coating 16, and a heater element 17 located inside roll 15. Conformable pressure roller 21 is typically a steel roller with silicone rubber coating 22.

The unfused image consists of a fine powder (toner) which has been placed in the form of a printed image on paper 11 by the well known electrophotographic printing process (not shown). Toner 14 is not tightly bound to the paper as it enters the fuser. The fuser unit bonds the toner to the surface of the paper by applying a combination of heat and pressure to the print. Heated roller 15 and compliant pressure roller 21 are held in interference contact. The unfused print passes between roller 15 and 21 where the heat (approximately 320° F.) and pressure cause the thermoplastic toner powder to be bonded to the surface of the paper. All of the elements of the fuser, as well as the printer and the elements of the preferred embodiment of the invention, are coupled or mounted to the housing, represented by reference numeral 18.

Immediately after fused print 23 exits the fuser, the print passes through the image permanence apparatus of the invention. As it approaches the image permanence apparatus the print is at a temperature of approximately 195° F. The image permanence apparatus includes dispenser cartridge 24, applicator roller 25 and engagement bar 26. The dispenser cartridge applies lubricating micropowder (PTFE) 28 to the external surface of the applicator roller which, due to forces which will be discussed later, causes the powder to adhere to that surface. Due to the pivoting action of engagement bar 26 about axis 29, as indicated by arrow 27, the paper is selectively placed in contact with the rotating applicator roller so that only those selected regions where it is desired to provide a lubricating overcoat actually are impressed with the micropowder coating.

Figure 2:
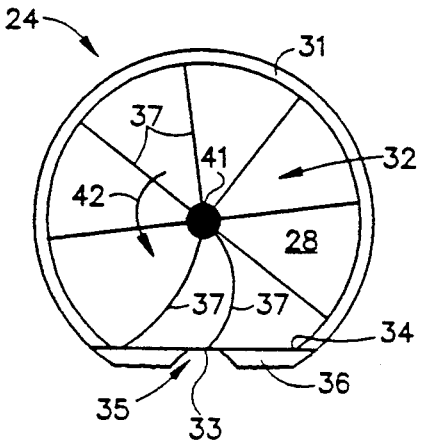
FIG. 2 is a enlarged sectional view of the powder dispenser cartridge of FIG. 1.

With particular reference to FIG. 2, dispenser cartridge 24 comprises a stationary tubular housing 31, a rotatable brush 32, and a sifting screen 33 which is positioned as a chord across opening 34 in the tubular housing. It will be assumed that dispenser 24 is at least partially filled with lubricating micropowder 28 but the powder material itself is not shown in the drawing for purposes of clarity. Housing 31 is an elongated tube approximately one-half inch (1.27 cm) in diameter and eight and one-half inches (21.6 cm) long, to conform to the width of the substrate passing through the image permanence device. In order to properly meter the amount of micropowder dispensed from cartridge 24, the exposed mesh of sifting screen 33 is reduced to narrow slit 35 by epoxy 36 partially covering the exposed surface of the screen and at the same time securing the screen to housing 31. For purposes of this invention, the sifting screen is preferably a 12×× mesh (120 strands/linear inch) polyester screen and slit 35 is approximately 0.095 inches (0.24 cm) in width. This is only an example for a suitable screen. Many others may function as well. Rotatably mounted within stationary housing 31 is brush 32 having bristles 37 which may be formed in any desirable pattern such as random or spiral on axial shaft 41. As the brush rotates in the direction of arrow 42, bristles 37 are in interference fit with the inside surface of sifting screen 33 as shown. This interference or brushing action causes the micropowder particles to sift lightly through opening 35 in the sifting screen, to drop onto the surface of applicator roller 25. Because the screen openings are so small, the micropowder will not pass through without the brushing action across its inner surface.

Once deposited on the applicator roller, the micropowder is rubbed against the surface of the roller by virtue of the rotation of roller 25 and the interference of wiping brush 43. This rubbing action serves to improve the adhesion forces (triboelectric and Van Der Waals forces) between the powder and the applicator roller. Wiping brush 43 is shown as part of the invention but while its effect is helpful, it is not necessary to the proper functioning of the image permanence apparatus.

The proper selection of micropowder material and applicator roller surface material enhances the adhesion of the powder to the roller surface. PTFE (Teflon) has high propensity to exchange electrostatic charges when brought into contact with other materials by virtue of its position on the triboelectric series. For example, from the Lenhard-Jacob Triboelectric Series, or as referenced in R. M. Schaffert, "Electrophotography," p. 558 (1975), Teflon has a "triboelectric charge propensity" of −200.0 while many other "poly-type" plastics have a triboelectric charge propensity ranging between −136 and +96. Thus Teflon is at one end of the triboelectric series, indicating that it exchanges charge readily with a wide variety of other materials when brought into contact with them.

Once electrostatic charge is exchanged between the Teflon powder and the roller surface material, the electrostatic attractive force between the powder and roller surface results in the Teflon being relatively well adhered to the roller. It has been found that the combination of Teflon powder and a silicone rubber coated applicator roller results in a positive coating of the Teflon powder on the applicator roller. The roller could also be polyurethane coated. This adhesion is due not only to the electrostatic charge but to the Van Der Waals forces which also contribute to the mutual attraction of the Teflon and the silicone rubber. Van Der Waals forces arise from the proximity force of the molecules involved whereas the electrostatic attraction force results from the exchange of electrostatic charge between the Teflon and the applicator roller.

It has been found that PTFE has ideal properties but other materials may be used for the lubricating micropowder as long as they have characteristics equivalent to Teflon. It has a low coefficient of friction but high electrostatic charge exchange which enables it to stick to the silicone rubber surface. It can be obtained in powder size ranging from 1 to 100 microns in diameter, which sizes function well with the invention. It is preferred that the powder have a range of 5–40 microns and commercially available PTFE powders are available in this size range.

Figure 3:
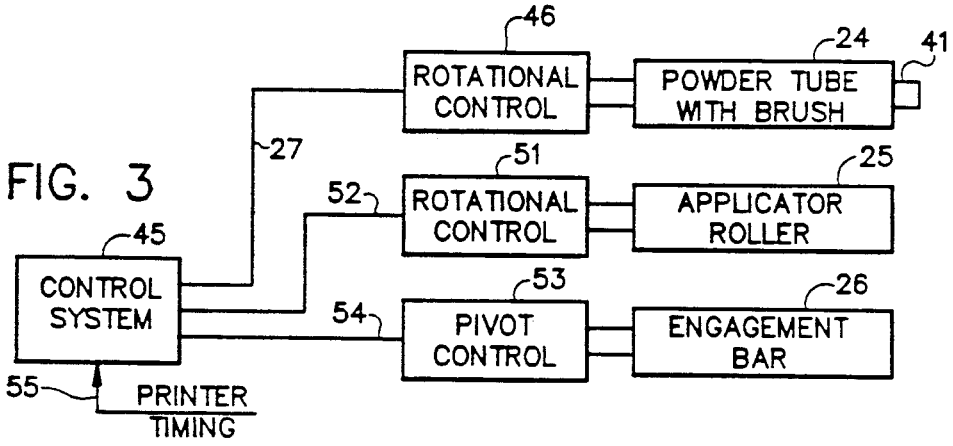
FIG. 3 is a block diagram of a system for controlling movement of the elements of the invention of FIG. 1.

An effective control arrangement for the operative elements of the image permanence apparatus is shown in FIG. 3. Control system 45 may be a microprocessor or other appropriate controlling device. Shaft 41 of the brush in housing 24 is connected to rotation control 46 which is in turn coupled to the control system by line 47. Applicator roller 25 is rotatable by means of rotation control 51 which is connected to the control system by means of line 52. Engagement bar 26 is controlled in its pivoting action by means of pivot control 53 which is connected to the controller system by means of line 54. The control system is set to coordinate with the operation of the electrophotographic printer so that it causes the elements of the image permanence apparatus to operate selectively. Printer timing information is provided by printer timing input 55 to the control system.

When it is desired to activate the image permanence system, dispenser brush 32 is rotated by rotation control 46 to dispense powder onto applicator roller 25. The applicator roller is rotated by rotation control 51 to bring it into rolling contact with paper 23 which has fused, but conformable, images thereon. Engagement bar 26 is raised selectively by pivot control 53, causing the image areas to be brought into contact with the applicator roller as desired. The region of contact between the print and the applicator roller is the application nip. This nip is formed by the pressure provided by the engagement bar when it is lifted into interference contact with the conformable applicator roller.

Figure 4:
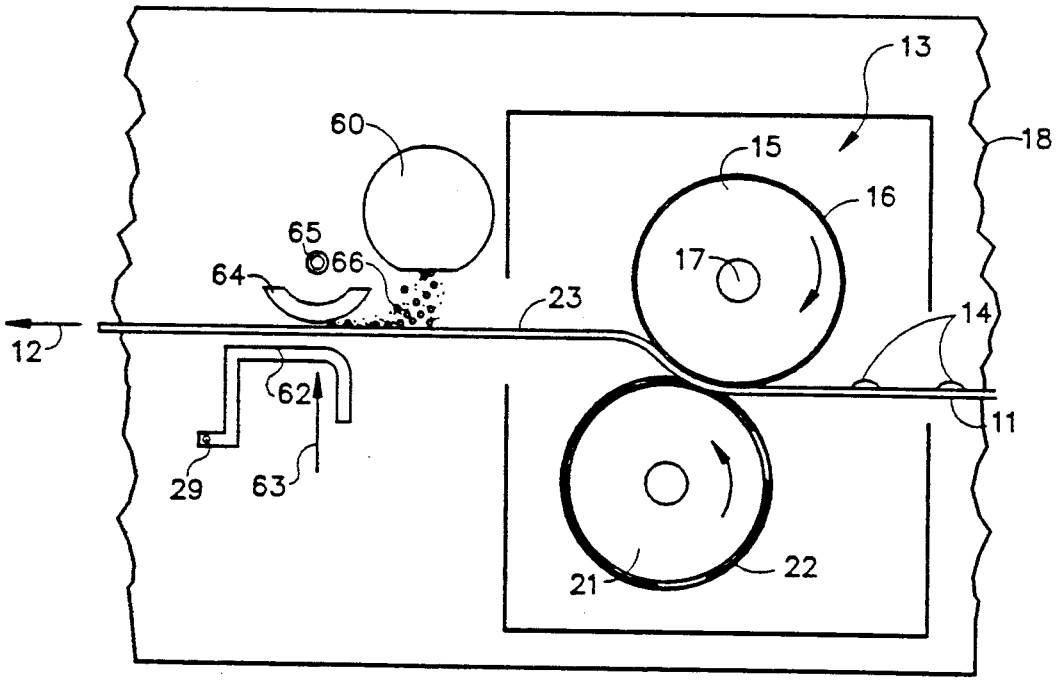
FIG. 4 is a schematic side view similar to FIG. 1 showing an alternative embodiment of the invention.

The tubular brush/screen dispenser and applicator roller combination for applying lubricating powder to the printed substrate is just one way to accomplish the powder applying purpose. An even simpler apparatus is shown in FIG. 4 where the sifting component 60 provides a continuous surface coating of powder 66 on the printed sheet. Excess powder can be easily collected and recycled. Engagement bar 62 then pivots in the direction of arrow 63 as previously described with respect to bar 26 in FIG. 1 to force the coated printed areas of particular interest against platen 64, while the toner is still at an adequately elevated temperature. An auxiliary heater 65 may be employed where necessary to achieve the desired elevated temperature at the nip. A radiant heater could be placed above or below the printed substrate between dispenser 60 and platen 64.

This simplified embodiment satisfies the requirement for the use of an elevated temperature coupled with selectively applied pressure to selectively cause the powder to adhere to the elements of interest. It can be seen that several methods may be used to achieve the result of an elevated temperature at the point that pressure is applied to the powder coated image elements.

The pressure in the applicator nip brings the printed image into intimate contact with the PTFE powder on the applicator roller surface. The temperature of the print at this point is sufficient so that the toner is still conformable. The combination of the conformable toner image, the PTFE powder coating on the applicator roller, and the pressure of the applicator nip, causes the PTFE powder to be pressed into the image areas of the print. As the PTFE powder presses into the toner, the contact area between the PTFE particles and the toner image areas increases which, in turn, increases adhesion between the PTFE particles and the image areas on the print. The adhesion force needed to separate the PTFE powder from the roller surface to which it is adhered is provided in large measure by Van Der Waals forces. The pressure and contact area, enhanced by the conformability of the toner, contribute to the PTFE being drawn away from the roller.

The electrostatic force and Van Der Waals forces in combination hold the powder particles on the surface of the roller. Van Der Waals and electrostatic forces are also acting in the applicator/engagement bar nip at the interface between the Teflon particles and the print, causing attraction between the particles and the print. In areas of the substrate containing toner, these forces are sufficient to cause the PTFE to adhere to the surface of the toner image and release from the roller. Forces causing the PTFE to be attracted to background areas of the print, for example, non-printed areas, are lower than either the attractive forces in image areas or attractive forces between the PTFE and the applicator roller.

Optimally, the image permanence structure will cause the PTFE powder to be selectively applied to image areas which are contacted by the applicator roller, but will inhibit the transfer of powder to non-image areas of the substrate. In optimum operation therefore, the attraction forces between the image and the PTFE powder ($F_I$) will be greater than the attraction forces between the powder and the applicator roller ($F_R$), which in turn will be greater than the attraction forces between the powder and background regions of the print ($F_{BKGD}$). That is, $F_I > F_R > F_{BKGD}$. The force balance in the applicator nip is a function of: the triboelectric properties of the powder, applicator roller, toner image areas and printed substrate; the temperature of the interface between the powder and the image areas of the applicator nip; the modulus of elasticity of the PTFE powder and the toner at the contact temperature which exists in the applicator nip; pressure profile through the contact nip; dwell time in the contact nip (preferably about 100 msec.); and relative motion between the print and the powder on the applicator roller.

The combination of the PTFE powder, a silicone rubber roller brought into rolling contact with the print, a nip engagement pressure of approximately 1.0 psi, and a nip temperature of about 190° F., will provide significantly enhanced image permanence performance when compared with previously known methods. This combination also causes powder to selectively adhere to the image areas as opposed to non-image areas of the substrate.

The invention as shown depends on the elevated temperature of the toner immediately after leaving the fuser. If that does not provide a sufficiently high temperature, or for other reasons the temperature of the toner must be increased, external radiant heater 61 can be provided in an alternative embodiment to raise the lubricating powder (and, of necessity, the applicator roller) temperature as necessary. An auxiliary heater such as heater 61 could be employed where the image permanence enhancement apparatus of the invention is not integrated with the printer so the image elements are at ambient temperature when approaching the apparatus. As another alternative, a heater could be provided which heats the toner itself.

The applicator roller is described as a solid roller with a compliant surface. It could also be formed as a thick bristled brush and would function adequately.

It is not necessary that the surface of the applicator roller be silicone rubber. Other substances could provide the necessary characteristics. However, this roller surface can stand the temperatures involved, is not amenable to chemical attack and it has a long experience history in xerographic and other printers.

Having described the structure of the invention, it is now appropriate to reiterate the advantages of this invention over the known prior art.

1) The method of this invention provides a means to selectively deposit and fix lubricating micropowder to image areas, that is, those areas containing imaging toner, in preference to non-image areas, that is, background areas. This selective deposition significantly reduces the amount of powder material required for optimum performance and reduces the amount of loose powder which is typically associated with powder coated images resulting in less extraneous powder "dirt."

2) This method causes the overcoating powder to be "fixed," that is, adhered to the images, resulting in improved durability, as measured by a rub test procedure employing a Sutherland, Inc. Rub Tester, made by James River Corp., and reduced propensity for the protective overcoat to dislodge during handling of the printed document.

3) The invention further provides a means to deposit powder only on selective regions of the printed document such that some portions of the image are coated and other portions of the image are uncoated. This further reduces the amount of the micropowder material which is consumed, and has advantages associated with handling large stacks of printed documents, such as checks, by maintaining high coefficient of friction of those portions of the document which do not need enhanced image permanence protection.

In view of the above description, it is likely that modifications and improvements will occur to those skilled in the art which are within the scope of the accompanying claims.

What is claimed is:

1. A method for enhancing the permanence of printed image elements on a substrate, said method comprising the steps of:

applying lubricant powder to the image elements;

applying pressure to the lubricant powder against the image elements; and providing enhanced temperature above ambient of the lubricant powder/image element interface;

whereby the lubricant powder adheres primarily to the printed image on the substrate and not to the background area of the substrate.

2. The method recited in claim 1, wherein said lubricant powder applying and pressure applying steps comprise the steps of:

applying the lubricant powder to the surface of an applicator roller;

moving the printed substrate into juxtaposition with the roller; and engaging the printed substrate with the lubricant powder coated surface of the roller.

3. The method recited in claim 2, and comprising the further steps of:

controlling said lubricant powder applying step to function in synchronism with the printing steps of a non-impact printer preceding said image permanence steps;

controlling rotation of the applicator roller to move in synchronism with the printing steps; and controlling the engaging step to function in synchronism with the printing steps.

4. The method recited in claim 2, wherein said engaging step is accomplished selectively so that portions of the printed surface engage the roller surface.

5. The method recited in claims 1, wherein said enhanced temperature providing step comprises heating the image substrate.

6. A method for enhancing the permanence of printed image elements on a substrate, said method comprising the steps of:

applying lubricant powder to an applicator roller;

applying heat to the external surface of the roller;

moving the printed substrate into juxtaposition with the hated roller; and engaging the printed substrate with the lubricant powder coated surface of the roller;

whereby the lubricant powder adheres primarily to the printed image on the substrate and not to the background area of the substrate.

7. The method recited in claim 6, and comprising the further steps of:

controlling said lubricant powder applying step to function in synchronism with the printing steps of a non-impact printer preceding said image permanence steps;

controlling rotation of the applicator roller to move in synchronism with the printing steps; and controlling the engaging step to function in synchronism with the printing steps.

8. The method recited in claim 6, wherein said engaging step is accomplished selectively so that portions of the printed surface engage the roller surface.

9. A method for enhancing the permanence of printed image elements on a substrate, said method comprising the steps of:

heating the image substrate above ambient temperature;

applying lubricant powder to an applicator roller;

moving the heated printed substrate into juxtaposition with the roller; and engaging the printed substrate with the powder coated surface of the roller;

whereby the lubricant powder adheres primarily to the printed image on the substrate and not to the background area of the substrate.

10. The method recited in claim 9, and comprising the further steps of:

controlling said lubricant powder applying step to function in synchronism with the printing steps of a non-impact printer preceding said image permanence steps;

controlling rotation of the applicator roller to move in synchronism with the printing steps; and controlling the engaging step to function in synchronism with the printing steps.

11. The method recited in claim 9, wherein said engaging step is accomplished selectively so that portions of the printed surface engage the roller surface.

* * * * *